US011452319B1

(12) United States Patent
Buonincontro

(10) Patent No.: US 11,452,319 B1
(45) Date of Patent: Sep. 27, 2022

(54) PROTECTIVE GARMENT

(71) Applicant: John Buonincontro, Bristol, VT (US)

(72) Inventor: John Buonincontro, Bristol, VT (US)

( * ) Notice: Subject to any disclaimer, the term of this patent is extended or adjusted under 35 U.S.C. 154(b) by 179 days.

(21) Appl. No.: 17/247,072

(22) Filed: Nov. 27, 2020

Related U.S. Application Data

(63) Continuation-in-part of application No. 29/688,340, filed on Apr. 19, 2019, now Pat. No. Des. 903,343.

(51) Int. Cl.
*A41D 13/05* (2006.01)

(52) U.S. Cl.
CPC ..... *A41D 13/0537* (2013.01); *A41D 13/0506* (2013.01); *A41D 13/0543* (2013.01); *A41D 13/0556* (2013.01); *A41D 13/0568* (2013.01)

(58) Field of Classification Search
CPC ..... A41D 13/0537; A41D 13/0506; A41D 13/0543; A41D 13/0556; A41D 13/0568; A41D 13/0575; A41D 13/0593; A63B 71/1225; A63B 2071/1233; A63B 2071/1241; A47C 1/16; A47C 9/10
USPC ..... 297/4
See application file for complete search history.

(56) References Cited

U.S. PATENT DOCUMENTS 1,128,122 A * 2/1915 Fox ..... A63B 71/1225 2/22
1,468,072 A * 9/1923 Ogle ..... A47C 27/081 128/DIG. 20
1,641,318 A * 9/1927 Carey ..... A63B 71/12 2/22
1,711,611 A * 5/1929 Mock ..... A41B 9/04 2/231
1,740,171 A * 12/1929 Goldsmith ..... A63B 71/12 2/22
1,774,739 A * 9/1930 Voyne ..... A41D 13/0506 2/467
2,332,141 A * 10/1943 Greene ..... A41C 1/00 450/98
2,516,598 A 7/1950 Selkirk
2,621,327 A * 12/1952 Amoroso ..... A41D 13/0537 2/46

(Continued)

FOREIGN PATENT DOCUMENTS

DE 177557 9/1905
FR 2624354 A1 6/1989

(Continued)

*Primary Examiner* — F Griffin Hall
(74) *Attorney, Agent, or Firm* — STGIP, LLC; Shawn Gordon

(57) ABSTRACT

An improved protective garment is form-fitting and comfortably secured to the wearer and includes a plurality of padding surfaces to adequately protect the wearer from moisture, cold, wind and uneven surfaces, while also providing pockets that are accessible from both a standing and seated position for storage or hand warming. The pads are held in separate compartments that are readily accessible so that users can replace and/or adjust the pads, such as by trimming them. These features allow for less encumbered motion of the wearer and are based on the construction and shape of the garment. The shape allows for both expansion of coverage on the wearer's body to include the crotch as well as lateral and anterior thighs extending from the waist to just above the knees.

5 Claims, 4 Drawing Sheets

(56) References Cited

U.S. PATENT DOCUMENTS 2,637,032 A * 5/1953 Pinsuti ..... A41D 27/26 2/23
2,829,386 A * 4/1958 Peer ..... B63C 9/08 297/118
3,185,362 A * 5/1965 Wakefield ..... A45F 3/00 2/24
3,212,690 A 10/1965 Green
3,708,799 A * 1/1973 Smithdeal ..... A41D 13/0537 2/46
3,909,847 A * 10/1975 Holt ..... A41D 1/088 2/466
4,151,613 A * 5/1979 Rhee ..... A63B 71/12 2/467
4,180,261 A * 12/1979 Kolka ..... A63B 21/065 2/22
4,303,239 A * 12/1981 Walsh, Jr. ..... A63B 21/065 224/904
4,735,423 A * 4/1988 Foss ..... B62B 15/00 280/18
4,737,994 A * 4/1988 Galton ..... A41D 13/0155 2/DIG. 3
4,761,834 A * 8/1988 Kolb ..... A41D 13/0568 2/338
4,807,301 A * 2/1989 Ferber ..... A61F 5/01 450/150
4,837,859 A * 6/1989 Hamberg ..... A41D 13/0537 2/24
4,894,867 A * 1/1990 Ceravolo ..... A41D 1/089 2/23
4,894,869 A * 1/1990 Boll ..... A41D 13/1254 2/400
4,923,247 A * 5/1990 Malmstrom ..... A47C 7/021 40/586
5,038,408 A * 8/1991 DeBaene ..... A41D 13/0537 D2/742
5,068,920 A * 12/1991 Bray ..... A41D 13/0537 2/458
5,086,514 A * 2/1992 Ross ..... A41D 13/0155 2/92
5,241,706 A * 9/1993 Netz ..... A41D 15/00 2/46
5,275,315 A * 1/1994 Carmack ..... A45F 4/02 224/684
5,398,667 A 3/1995 Witt
5,497,511 A * 3/1996 Zade ..... A41D 13/0506 2/22
5,551,091 A * 9/1996 Tyndall ..... A41D 13/0537 2/227
5,584,072 A * 12/1996 Kim ..... A63B 71/12 2/22
5,625,895 A 5/1997 Sovereign
5,652,957 A * 8/1997 Williford ..... A41D 13/05 2/22
5,675,844 A * 10/1997 Guyton ..... A41D 13/0518 2/22
5,727,260 A * 3/1998 Torch ..... A41D 13/0537 2/466
5,842,232 A * 12/1998 Parrish ..... A41D 13/0575 450/97
6,161,220 A 12/2000 Crisp
6,175,959 B1 * 1/2001 Somers ..... A41D 13/0537 2/455
6,266,818 B1 * 7/2001 Howland ..... A41D 17/00 89/922
6,345,391 B1 * 2/2002 Somers ..... A41D 13/0537 2/46
6,345,396 B1 * 2/2002 Schuler ..... A41D 13/0537 2/467
6,532,599 B1 3/2003 Dugan
6,820,938 B2 * 11/2004 Barrett ..... A47C 7/021 297/452.41
6,874,168 B1 * 4/2005 Kuhuski ..... A41D 27/26 2/227
7,266,850 B1 * 9/2007 Strum ..... F41H 1/02 2/2.5
D584,479 S * 1/2009 Jones ..... D29/101.5
7,487,557 B2 * 2/2009 Bellfy ..... A41D 13/0556 2/465
7,651,016 B2 1/2010 Stewart
D627,932 S * 11/2010 Mendoza ..... D29/101.5
7,937,767 B2 * 5/2011 Leach ..... A63B 71/1225 2/22
8,032,949 B1 * 10/2011 Matthews ..... A41D 15/04 2/102
D648,167 S * 11/2011 Colon ..... D6/601
8,272,073 B2 * 9/2012 Arensdorf ..... A41D 1/08 2/228
9,265,291 B2 * 2/2016 Weber ..... A41D 13/0543
10,212,974 B1 * 2/2019 Joshi ..... A41D 13/0506
10,376,002 B2 * 8/2019 Matthews ..... A45F 5/02
D903,343 S * 12/2020 Buonincontro ..... D6/334
2005/0106997 A1 * 5/2005 Smith ..... A41D 13/0537 450/94
2006/0064045 A1 * 3/2006 Khavari ..... A61F 5/0102 602/19
2006/0107435 A1 * 5/2006 Westcott ..... A41D 17/02 2/69
2006/0206986 A1 * 9/2006 Straiton ..... A41D 1/089 2/238
2008/0109929 A1 5/2008 Soules
2010/0024104 A1 * 2/2010 Sims ..... A63B 71/1216 2/466
2011/0072545 A1 * 3/2011 Bennett ..... A41D 13/0543 2/229
2013/0191956 A1 * 8/2013 Elliott ..... A41D 13/0531 2/46
2014/0008401 A1 * 1/2014 Scott ..... A47C 7/021 224/155
2016/0331048 A1 11/2016 Runcie

FOREIGN PATENT DOCUMENTS

FR 2975570 A1 * 11/2012 ..... A41D 13/0537
GB 2524267 A * 9/2015 ..... A41D 13/0537
GB 2524267 A 9/2015

* cited by examiner

PROTECTIVE GARMENT

FIELD OF THE INVENTION

The present invention generally relates to protective outerwear. In particular, the present invention is directed to a protective garment with padding.

BACKGROUND

Various types of outerwear and other garments are designed to be worn around a user's waist and provide a wearable "seat" or other protections, such as insulation or waterproofness, in cold weather or when seated on uneven surfaces. Typically, these garments may include a layer of non-permeable material and padding. Some are worn and others are deployed when the user is to transition from standing to a seated position.

SUMMARY OF THE DISCLOSURE

A protective outer garment for wearing around a wearer's waist includes a fabric layer having a top edge, a first leg outer side edge, a first leg inner side edge, a second leg outer side edge, a second leg inner side edge, a first leg bottom edge, and a second leg bottom edge; a crotch portion attached to the fabric layer between the first leg inner side edge and the second leg inner side edge; a waist securement mechanism at the top edge configured to secure the top edge of the garment around the wearer's waist; and a plurality of sleeves attached to a wearer-facing side of the fabric layer, wherein each of the plurality of sleeves is configured to removably house a pad and wherein each of the plurality of sleeves is discontinuous with each other such sleeve. When in an unworn configuration the first leg outer side edge is detached from the first leg inner side edge and the crotch portion and the second leg outer side edge is detached from the second leg inner side edge and the crotch portion. When in a worn configuration, the first leg outer side edge is attached to the first leg inner side edge and the crotch portion and the second leg outer side edge is attached to the second leg inner side edge and the crotch portion.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
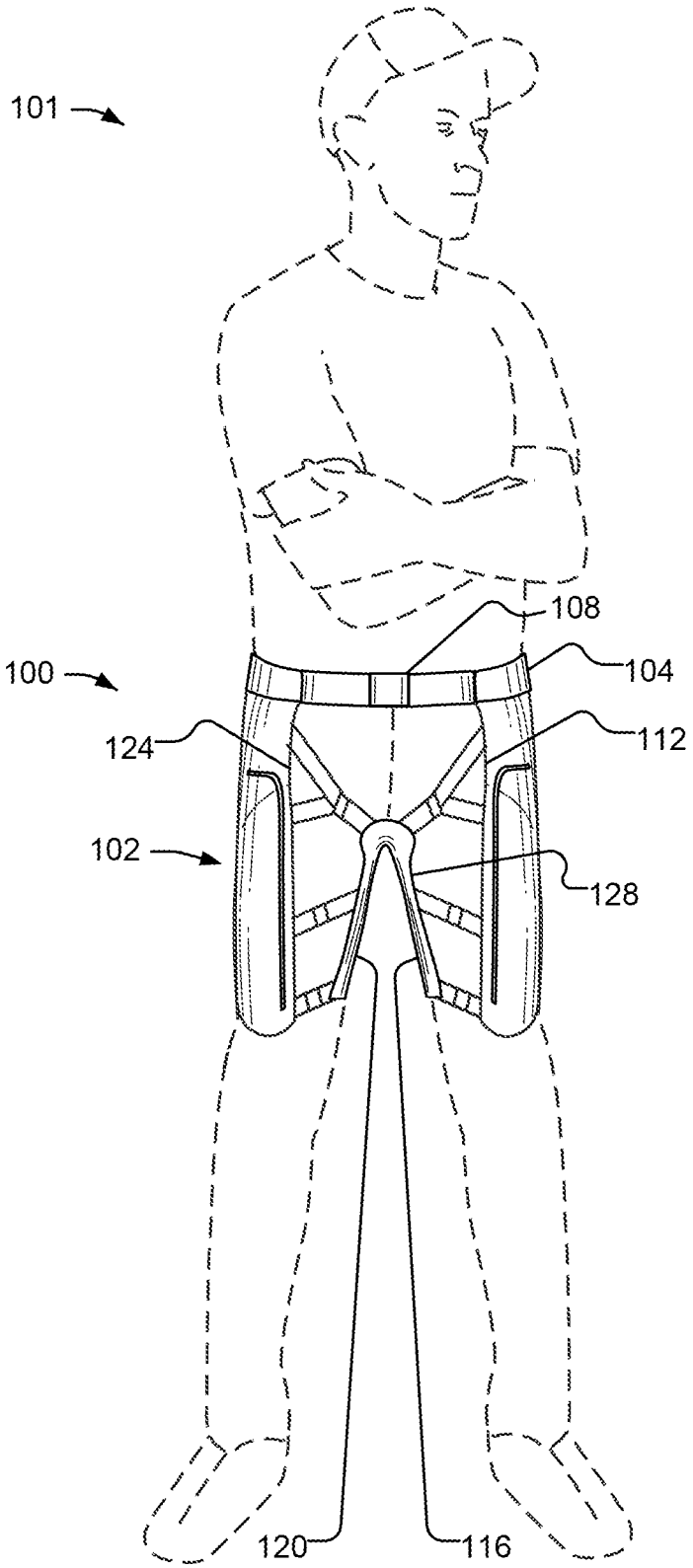
FIG. 1 depicts a protective garment worn by a wearer in accordance with an embodiment of the present invention.

An improved protective garment is form-fitting and comfortably secured to the wearer and includes a plurality of padding surfaces to adequately protect the wearer from moisture, cold, wind and uneven surfaces, while also providing pockets that are accessible from both a standing and seated position for storage or hand warming. The pads are held in compartments that are readily accessible so that users can replace and/or adjust the pads, such as by trimming them. These features allow for less encumbered motion of the wearer and are based on the construction and shape of the garment. The shape allows for both expansion of coverage on the wearer's body to include the crotch as well as lateral, medial, and anterior thighs extending from the waist to just above the knees. The garment is made from suitable materials having a stretch property, and may be constructed from sections that are sewn together in such a way as to extend from the wearer's posterior to the anterior along the outside of the thighs as well as between the legs protecting the crotch, allowing for improved security of the garment on the body and better protection while seated. The shape of the sections together with the material and this construction limit the bulkiness and bunching of this material for an improved fit and comfort while still providing waterproofing, insulating, and other protective properties.

Two pieces of fabric are sewn together vertically (with respect to a standing wearer when worn). The shape of these two pieces provide substantial coverage of the wearer's groin, buttock, posterior, medial, and lateral and anterior thighs without excess bulkiness.

This garment adds protection from cold, wind, and moisture due in part to the expansion of the overall garment and the use of waterproof and breathable fabrics having, preferably, two and four way stretch characteristics. The two piece design of this layer provides the shape needed to extend from the buttock to the front of the user protecting the groin while not encumbering user comfort.

The garment has a designed fit to include coverage of the wearer from the waist down to about the knees by wrapping around the outer thighs and hips as well as through the groin to the inner thigh, again extending down toward or to the knees. These are the areas that are often most in need of protection in cold or wet conditions and/or on uneven surfaces.

An outer layer of the garment is made of material cut to a pattern that facilitates fit around the lower torso/waist and thighs. As noted above, the materials used may vary, including but not limited to water and wind proof, coated, stretch or static, mesh, cotton or nylon. The particular choice of materials may vary depending on the specific intended uses. For example, if being waterproof is a primary requirement for the garment, sewing of the garment's layers could lead to a compromise of the outermost layer, particularly in the area of the garment on which the user would tend to directly sit.

The addition of an inner layer of material is beneficial for environmental protection, e.g., water and wind, and a water or wind proof outer layer is needed. The inner layer is used to attach the pockets for the padding, additional storage pockets that lie against the user when the garment is worn, and the anchoring of leg straps. This allows the outermost layer to have only a circumferential seam, as well as outer pockets and the belt. The seams may be further waterproofed by the use of appropriate tapes.

For situations in which insulation from cold or moisture is not necessary, a single layer construction pattern using material with limited or no waterproof or windproof characteristics can be used, sewing inner padding as well as outer pockets, strapping, belt and accessories directly onto this layer. Similarly, a removable outer layer, anchored by circumferential zippers, can be used to facilitate changes to outermost patterns. This may be useful for hunters, for example, who can replace the outer layers with materials having different camouflage patterns. The same inner layer may be used with padding, straps, and belt for skiing or snowboarding, and then a different outer layer can be used when hunting.

The garment of the present invention may be worn over the user's clothing. This allows for use in multiple activities. Moreover, the garment facilitates the expansion of the protected areas, anchors the garment in such a way as to limit displacement during various activities/motions of the wearer, and, by wrapping around the wearer's thighs. facilitates anchoring as well as providing areas for storage and hand warming pockets. The external pockets of the garment are sewn to the outermost layer of the garment and extend along the vertical and lower edge of the thigh of the wearer, along the lateral thigh, and extend to the padding in the back. These pockets essentially mirror the shape of the overall garment as it extends from the anterior of the thigh around the lateral thigh to the padding along the hip/buttock and the back of the thigh (posterior). This positioning, with the placement of an access, which may be closed with any suitable closure and preferably waterproof zippers, extending along the anterior thigh and arcing back to the wearers hip and buttock, allows for two way closures and access to the pockets from both the seated and standing position with ease.

An integrated belt made of static and stretch material supports the garment's fit to the user thereby limiting displacement or unwanted shifting. Preferably, a 2-3 inch two-way elastic material, anchored to the garment along the entire waist, combined with a static nylon webbing belt is used to anchor the garment to the waist while also maintaining its stretch and associated fit. Similarly, the use of straps and closures, referred to above, along the anterior/front of the thigh, extending downward from the groin to the lower thigh, helps maintain the garment in position without overly restricting the wearer's movements. The straps are are aligned in such a way as to maintain a tension between the medial and lateral edges of the garment and the fabric that covers the wearer's groin. In an embodiment, there is a gap between these edges when worn. These edges may be extended to each other across the front of the thigh and have attachment points so that fewer or no straps would be needed. Similarly, an overlapping piece of material to which these straps may be anchored may be used to limit this exposure.

The shape of the garment and the use of these closures, whether straps are used or not, facilitates ease of putting on and removing the garment. Different types of closing mechanisms may be used to facilitate adjustment of the tightness of each strap thereby allowing the wearer to determine the snugness of the fit.

Padding within pockets or sleeves of the garment provide comfort on uneven surfaces and can limit pressure and exposure to cold, and further provide additional moisture protection depending on the material used for the pads. The shape and placement of the pads are selected for providing protection. In an embodiment, three pads are used in separate pockets/sleeves in order to provide protection in the right places while allowing the wearer to not be overly restricted in movement. For example, a pad may have rounded corners as well as surface hatching to facilitate the pad conforming the human form when the garment is worn. The pads fit into pockets shaped to accept each pad. In this way, the pads may be easily removed and replaced. Additionally, the pads may be trimmed or otherwise adjusted by the wearer as needed and replaced in the pockets/sleeves, which are preferably made of a material that can stretch.

As noted, in a preferred embodiment, three pads may be used. This includes a pad across the buttock area, and pads on each leg area, each of which may include indentations or hatching of the surface thereby creating the flexibility to form to the wearers body. These are designed to slip into pockets/sleeves attached to the innermost side of the garment. The noted ability to remove and replace these is beneficial to the user as it accommodates variations to pad thickness dependent on use/climate as well as the aforementioned ability for the user to trim the pads to individual requirements.

In general, the uppermost of the three or more pads is positioned in the garment such that it covers the wearer's posterior, extending from the lumbar back to the coccyx while extending laterally to overlay the gluteal region on both the right and left side. Extension to the hips provides adequate protection of this region when seated. The lower two pads, a right and left, are shaped to abut the lower edge of the upper pad in order to minimize the gap when the garment is being worn. The sleeves that secure the pads allow for the anchoring of the pads in position while their structural discontinuity facilitates a range of movement and comfort when in use.

In a preferred embodiment, the lower pads are sized, positioned, and shaped to extend from the topmost posterior thigh, extending from the lateral to the medial edge of the upper pad, down toward or to the wearer's knee. The lower pads cover the posterior and inside of the upper thigh and then taper down the leg to terminate above the knee. This positioning and shape facilitate providing protection from the elements along the major body areas that tend to be in contact with a surface when the wearer is seated without extra bulkiness.

The padding material may also be changed to accommodate different needs of wearers. In other settings, such as for medical uses, pressure relief may be needed, in which case the removable pads may be shaved or carved so that specific portions of a region of the body that is generally covered by a pad have less or no padding. For example, padding material that overlays an existing wound may be reduced or removed to allow for dressing application or, as a preventative measure over chronic or injury prone locations. For these applications, the pads may include pre-cut sections that can be removed or rearranged as needed for a patient's particular needs.

In addition, a harness system may be included, the straps of which can be incorporated into the garment and extend above and over the wearer's body in the traditional manner and fit. This could be used for activities such as mountaineering or climbing, hunting from a tree stand or working in an environment where safety goals necessitate harness use.

Further, additional pockets both exterior and interior or body side, lumbar pack or support, or a belt system with attachment points through the addition of D-rings or loops may be included on the garment.

In addition to outdoor activities, the garment of the present invention may be worn as a pressure relief device, with the goal of limiting wound development from continued unprotected pressure, e.g., when sitting or lying for extended periods of time, being unable to change positions independently, or in cases of paralysis which, by denying the subjective sensation of pain, often leads to wound development. The garment may also be used as a preventive device and benefit those at risk for these issues either acutely and temporarily or chronically with long term utilization benefits. For these purposes, the garment may be modified to further limit complications of moisture coming from the wearer, e.g., sweat, urine, stool, or wound drainage, by adapting the material for the layers and padding. Likewise, the shape of the pads may be altered to most support common pressure points of the human body when in a prone position. Further, these alterations may be tailored to specific patients and their needs (e.g., male/female, ht., wt. etc.).

In addition, loops or fasteners may be placed on the inner side of the outer layer of fabric and counterpart similar loops or fasteners may be attached to the outside aspect of the inner layer of fabric. In this way, the inner and outer fabric layers are secured by more than the attachment points along the circumferential edge. Without these extra points of attachment, more displacement and subsequent wear of the outermost layer of fabric may occur, decreasing lifespan of the garment. Further, the extra attachment points support the fit of the entire garment to the wearer.

FIG. 1 depicts a protective garment 100 worn by a wearer 101 and having a fabric layer 102. A waistband 104 runs along a top edge of fabric 102 and is preferably stretchable and may be secured to wearer 101 with a buckle 108 or similar mechanism, such as a plastic side release buckle. Fabric 102 includes a first leg outer edge 112 and a first leg inner edge 116 as well as a second leg outer edge 124 and a second leg inner edge 120. In addition, fabric 102 includes a crotch portion 128 between first leg inner edge 116 and second leg inner edge 120 and extends partially up toward waistband 104. Crotch portion 128 may be part of a continuous piece of fabric with the rest of fabric layer 102 or may be a separate piece of fabric attached to fabric layer 102.

Figure 2:
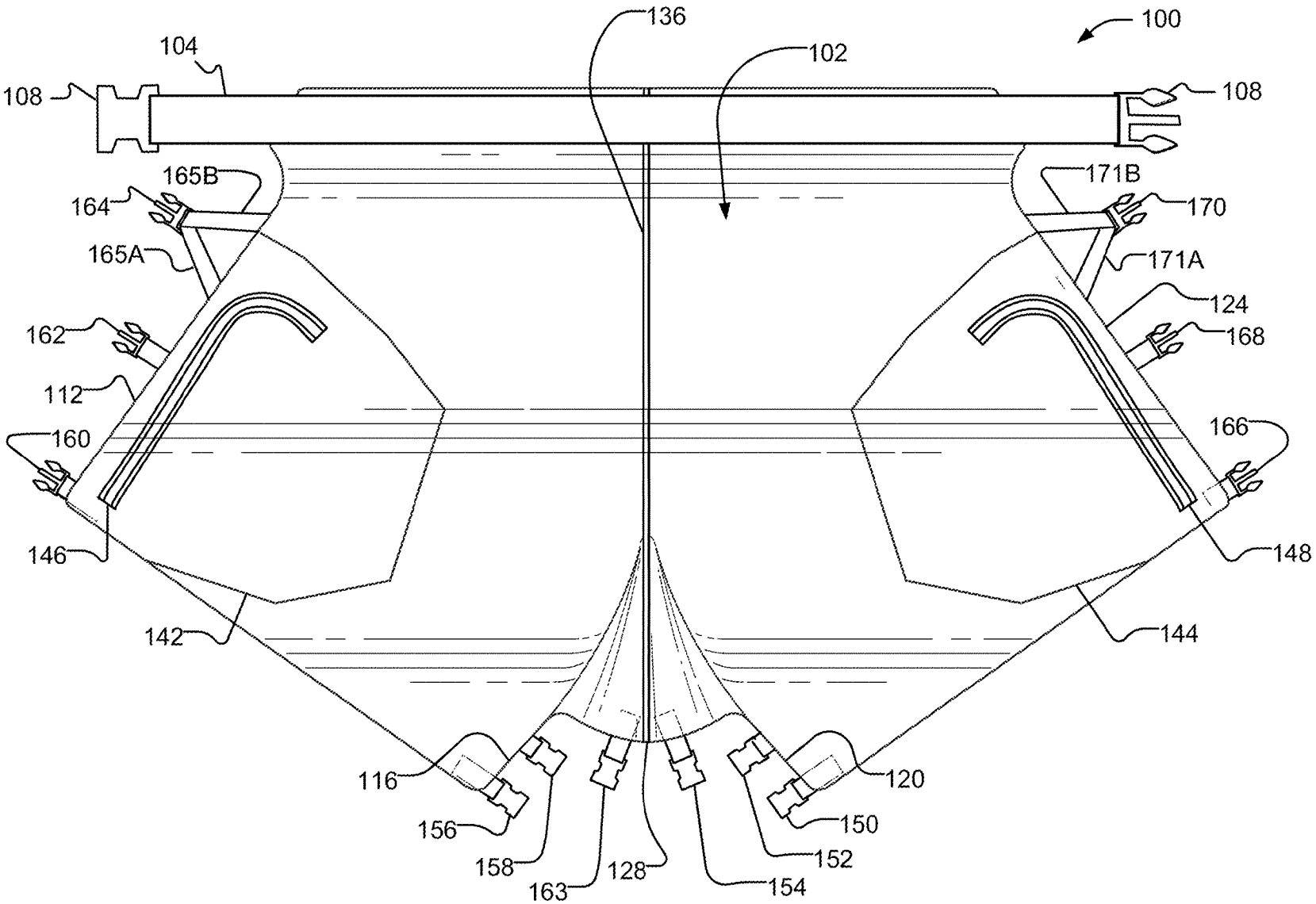
FIG. 2 is a front view of a protective garment with attachments unconnected in accordance with an embodiment of the present invention.

Turning to FIG. 2, a rear (or outer-facing when worn) view of garment 100 is shown when laid flat and unattached to a wearer. Each leg area may include pockets (142, 144) which may be closable with zippers (146, 148) or similar. As can be seen, pockets 142, 144 are accessible to a wearer when the wearer is in either a sitting or standing position. Fabric layer 102 is shaped to fit securely and comfortably around the wearer while still allowing for ease of motion. To that end, fabric layer 102 may preferably include a vertical seam 136 and flexible crotch portion 128 between first leg inner edge 116 and second leg inner edge 120. To secure garment 100 to the wearer, securement mechanisms are positioned along the edges of fabric layer 102 and crotch portion 128. In particular, in an embodiment, attachment mechanisms are attached to first leg outer edge 112 and may include an upper attachment 164, which may preferably be connected to fabric layer 102 via a pair of straps 165 (e.g., 165A, 165B), a middle attachment 162, and a lower attachment 160. These attachments are positioned to connect to counterpart attachments on first leg inner edge 116 and crotch portion 128. First leg inner edge 116 may include an upper attachment 158 and a lower attachment 156, which are configured to be connected to middle attachment 162 and lower attachment 160, respectively. In addition, crotch portion 128 includes an attachment 163 that is configured to be connected to upper attachment 164 of first leg outer edge 112. These attachments provide stability so that the wearer can perform various activities without interference while the stretchability of fabric layer 102 assures that the wearer at the same time won't be encumbered. Furthermore, these connections provide significant coverage and protection from cold and wet surfaces while allowing garment 100 to be easily put on and taken off. Second leg outer edge and second leg inner edge, as well as crotch portion 128, include the same connectors to provide securement of the second leg. In particular, in an embodiment, attachment mechanisms are attached to second leg outer edge 124 and may include an upper attachment 170, which may preferably be connected to fabric layer 102 via a pair of straps 171 (e.g., 171A, 171B), a middle attachment 168, and a lower attachment 166. These attachments are positioned to connect to counterpart attachments on second leg inner edge 120 and crotch portion 128. Second leg inner edge 120 may include an upper attachment 152 and a lower attachment 150, which are configured to be connected to middle attachment 168 and lower attachment 166, respectively. In addition, crotch portion 128 includes an attachment 154 that is configured to be connected to upper attachment 170 of second leg outer edge 124.

Figure 3:
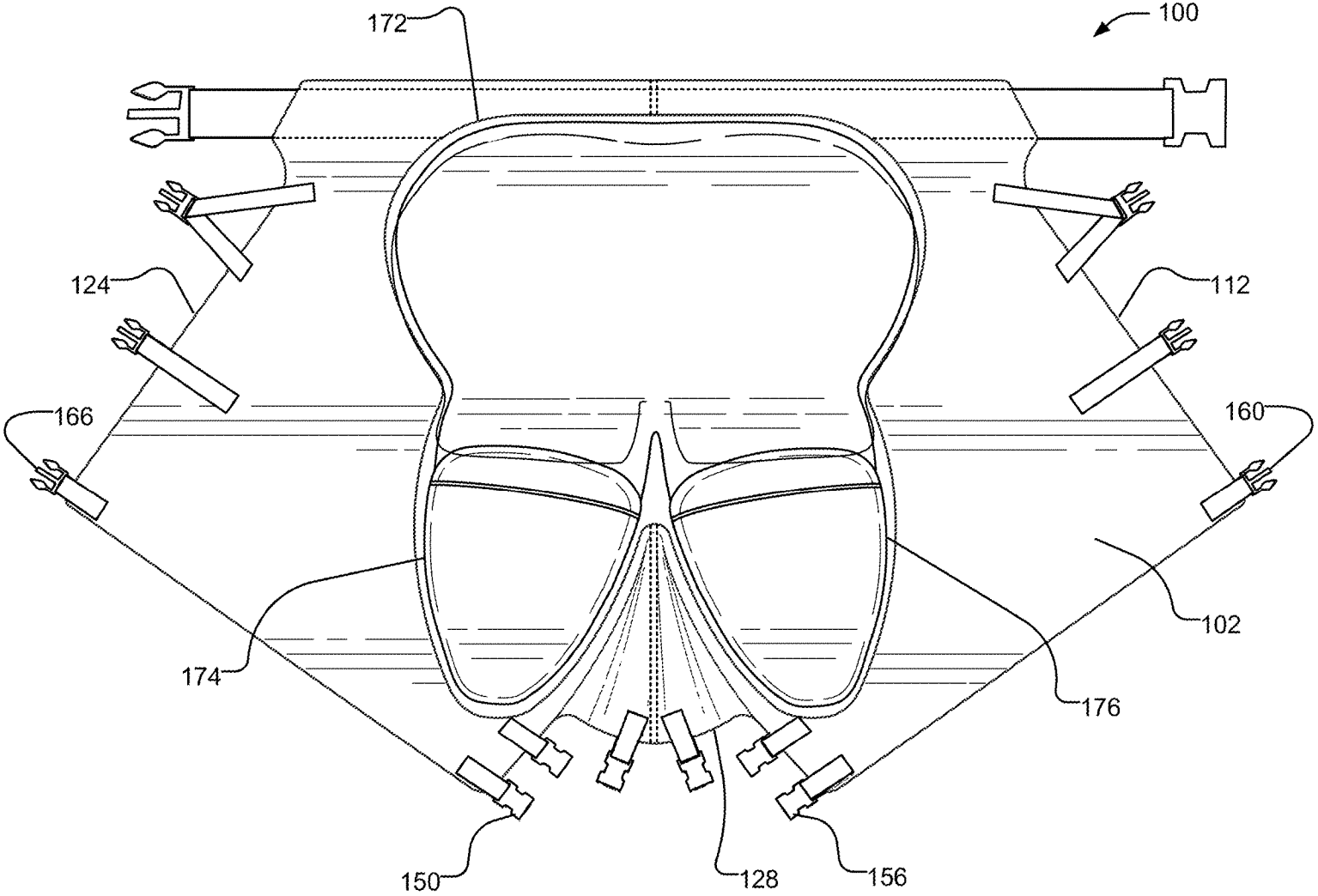
FIG. 3 is a rear view of a protective garment with attachments unconnected in accordance with an embodiment of the present invention.

In FIG. 3, a front or user-facing when worn view of garment 100 is shown. A sleeve 172 is attached to the user-facing side of fabric layer 102 for holding a pad. Sleeve 172 is positioned to hold a pad over the wearer's buttock area. Two additional sleeves, a first leg sleeve 176 and a second leg sleeve 174, are positioned below sleeve 172 and on each respective leg area, and are configured to hold pads. In this way, adequate padding is provided for a siting or prone wearer while at the same time, because the pads are separate and held in separate sleeves, the wearer's movements are less encumbered even if the pads are relatively substantial in terms of thickness or other properties which allow for greater protection.

Figure 4:
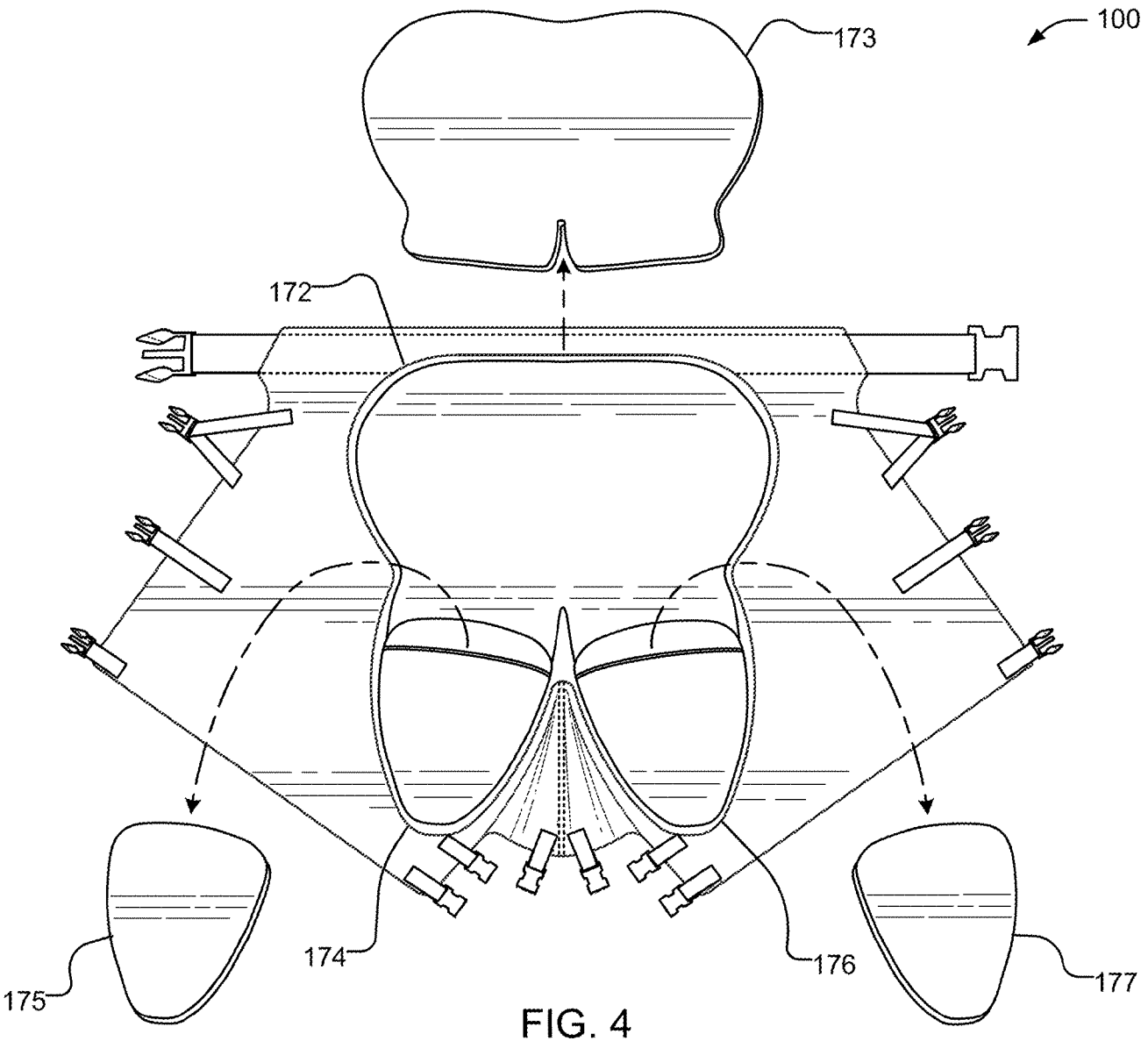
FIG. 4 is another rear view of a protective garment with attachments unconnected and with pads removed from sleeves in accordance with an embodiment of the present invention.

In FIG. 4, the front or user-facing when worn view of garment 100 is again shown but with pads removed from sleeves. In particular, in the embodiment shown a buttock pad 173 is removed from sleeve 172, a first leg pad 177 is removed from sleeve 176, and a second leg pad 175 is removed from sleeve 174. As noted, and due in part to the flexibility of the sleeves, the pads may be shaped, trimmed, or otherwise customized for a particular user or for a particular need of a user.

In an embodiment, a protective outer garment for wearing around a wearer's waist includes a front portion, a rear portion, a first side portion having a first side inner edge and a first side outer edge, a second side portion having a second side inner edge and a second side outer edge, a top edge, a first bottom edge, a second bottom edge, and a crotch portion, wherein a waist portion is included along the top edge; a first sleeve on the rear portion, the first sleeve configured to removably house a first pad; a second sleeve on the rear portion and the first side portion, the second sleeve configured to removably house a second pad, wherein the second sleeve is below the first sleeve and discontinuous with the first sleeve; a third sleeve on the rear portion and the second side portion, the third sleeve configured to removably house a third pad, wherein the third sleeve is below the first sleeve and discontinuous with the first sleeve and the second sleeve; a waist securement mechanism on the first side outer edge and the waist portion and a counterpart waist securement mechanism on the second side outer edge and the waist portion, wherein the waist securement mechanism and the counterpart waist securement mechanism are configured to be connected at the front portion when the garment is worn by the wearer; an upper first side outer edge securement mechanism attached to the first side outer edge; a middle first side outer edge securement mechanism attached to the first side outer edge below the upper first side outer edge securement mechanism; a lower first side outer edge securement mechanism attached to the first side outer edge below the middle first side outer edge securement mechanism; a first crotch securement mechanism attached to the crotch portion; an upper first side inner edge securement mechanism attached to the first side inner edge attached to the first side inner edge below the first crotch securement mechanism; a lower first side inner edge securement mechanism attached to the first side inner edge below the upper first side inner edge securement mechanism; an upper second side outer edge securement mechanism attached to the second side outer edge; a middle second side outer edge securement mechanism attached to the second side outer edge below the upper second side outer edge securement mechanism; a lower second side outer edge securement mechanism attached to the second side outer edge below the middle second side outer edge securement mechanism; a second crotch securement mechanism attached to the crotch portion; an upper second side inner edge securement mechanism attached to the second side inner edge attached to the second side inner edge below the second crotch securement mechanism; and a lower second side inner edge securement mechanism attached to the second side inner edge below the upper second side inner edge securement mechanism. When worn by the wearer, the upper first side outer edge securement mechanism is connected to the first crotch securement mechanism, the middle first side outer edge securement mechanism is connected to the upper first side inner edge securement mechanism, the lower first side outer edge securement mechanism is connected to the lower first side inner edge securement mechanism, thereby forming a first side leg, and wherein the upper second side outer edge securement mechanism is connected to the second crotch securement mechanism, the middle second side outer edge securement mechanism is connected to the upper second side inner edge securement mechanism, the lower second side outer edge securement mechanism is connected to the lower second side inner edge securement mechanism, thereby forming a second side leg.

Additionally, a pocket is sewn to an outermost layer of the first front portion and the first side portion, wherein an opening of the pocket extends along the first side outer edge. A second pocket may be sewn to an outermost layer of the second front portion and the second side portion, wherein an opening of the pocket extends along the second side outer edge.

In another embodiment, a protective outer garment for wearing around a wearer's waist includes a fabric layer having a top edge, a first leg outer side edge, a first leg inner side edge, a second leg outer side edge, a second leg inner side edge, a first leg bottom edge, a second leg bottom edge, and a crotch portion between the first leg inner side edge and the second leg inner side edge; a waist securement mechanism at the top edge configured to secure the top edge of the garment around the wearer's waist; a first sleeve on a wearer-facing side of the fabric layer, the first sleeve configured to removably house a first pad; a second sleeve on the wearer-facing side of the fabric layer, the second sleeve configured to removably house a second pad, wherein the second sleeve is below the first sleeve and discontinuous with the first sleeve; a third sleeve on the wearer-facing side of the fabric layer, the third sleeve configured to removably house a third pad, wherein the third sleeve is below the first sleeve and discontinuous with the first sleeve and the second sleeve; a first securement mechanism attached to the first leg outer side edge; a second securement mechanism attached to the first leg outer side edge beneath the first securement mechanism; a third securement mechanism attached to the crotch portion and configured to connect to the first securement mechanism when worn by the wearer; a fourth securement mechanism attached to the first leg inner side edge and configured to connect to the second securement mechanism when worn by the wearer; a fifth securement mechanism attached to the second leg outer side edge; a sixth securement mechanism attached to the second leg outer side edge beneath the fifth securement mechanism; a seventh securement mechanism attached to the crotch portion and configured to connect to the fifth securement mechanism when worn by the wearer; and an eighth securement mechanism attached to the second leg inner side edge and configured to connect to the sixth securement mechanism when worn by the wearer.

Additionally, the first securement mechanism is attached to the first leg side edge via a first strap and a second strap, and wherein the first strap is attached to the fabric layer at a higher point than the second strap.

Additionally, a pocket is on an outside facing side of the fabric layer.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A protective outer garment comprising:

a fabric layer having a top edge, a first leg outer side edge, a first leg inner side edge, a second leg outer side edge, a second leg inner side edge, a first leg bottom edge, and a second leg bottom edge;

a crotch portion attached to the fabric layer between the first leg inner side edge and the second leg inner side edge;

a belt with a buckle at the top edge configured to secure the top edge of the garment around a waist of a wearer; and a plurality of sleeves attached to a wearer-facing side of the fabric layer, wherein each of the plurality of sleeves is configured to removably house a pad and wherein each of the plurality of sleeves is discontinuous with each other such sleeve;

wherein, when in an unworn configuration, the first leg outer side edge is detached from the first leg inner side edge and the crotch portion and the second leg outer side edge is detached from the second leg inner side edge and the crotch portion, and wherein, when in a worn configuration, the first leg outer side edge is attached to the first leg inner side edge and the crotch portion and the second leg outer side edge is attached to the second leg inner side edge and the crotch portion.

2. The protective outer garment of claim 1, wherein the plurality of sleeves includes an upper sleeve for containing a first pad, a right leg sleeve for containing a right leg pad, and a left leg sleeve for containing a left leg pad.

3. The protective outer garment of claim 2, wherein, when worn by the wearer, a bottom edge of the first pad abuts a top edge of the right leg pad and the bottom edge of the first pad abuts a top edge of the left leg pad.

4. The protective outer garment of claim 3, wherein the first pad is sized and positioned, when the garment is worn by the wearer, to cover the wearer's posterior by extending vertically from a lumbar back of the wearer to a coccyx of the wearer and extending laterally to overlay a right side gluteal region of the wearer and a left side gluteal region of the wearer.

5. The protective outer garment of claim 4, wherein each of the right leg pad and the left leg pad are sized, positioned, and shaped to extend, when worn by the wearer, from a topmost posterior thigh of the wearer, and from a lateral to a medial edge of the first pad, down toward a respective knee of the wearer.

* * * * *